US008770943B2

(12) United States Patent
Ishihara

(10) Patent No.: US 8,770,943 B2
(45) Date of Patent: Jul. 8, 2014

(54) AXIAL FLOW FAN

(75) Inventor: Katsumichi Ishihara, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 1090 days.

(21) Appl. No.: 12/644,385

(22) Filed: Dec. 22, 2009

(65) Prior Publication Data

US 2010/0158677 A1 Jun. 24, 2010

(30) Foreign Application Priority Data

Dec. 22, 2008 (JP) ..... 2008-326283

(51) Int. Cl.
*F01D 1/04* (2006.01)
*F01D 5/14* (2006.01)
*F01D 5/16* (2006.01)

(52) U.S. Cl.
USPC ..... 416/235

(58) Field of Classification Search
USPC ..... 415/220; 416/189, 223 R, 228, 235, 416/236 R, 242, 243
See application file for complete search history.

(56) References Cited

U.S. PATENT DOCUMENTS

| | | | | |
|---|---|---|---|---|
| 6,994,523 | B2 * | 2/2006 | Eguchi et al. | 416/228 |
| 8,007,243 | B2 * | 8/2011 | Arinaga et al. | 416/228 |
| 2003/0123988 | A1 | 7/2003 | Wen | |

FOREIGN PATENT DOCUMENTS

| | | | |
|---|---|---|---|
| JP | 11-044432 | | 2/1999 |
| JP | 3089140 | U | 10/2002 |
| JP | 2003-148395 | | 5/2003 |
| JP | 2006-002584 | | 1/2006 |
| JP | 2006002585 | A * | 1/2006 |
| JP | 2008051074 | A * | 3/2008 |

* cited by examiner

*Primary Examiner* — Nathaniel Wiehe
*Assistant Examiner* — Sean J Younger
(74) *Attorney, Agent, or Firm* — Rankin, Hill & Clark LLP

(57) ABSTRACT

An axial flow fan includes a blade having a curved portion formed in the vicinity of a radially outer end portion positioned opposite to the base portion in the radial direction of the peripheral wall portion of the hub. The curved portion is convex in the rotation direction, concave in the direction opposite to the rotation direction, and extends along the radially outer end portion of the blade. The curved portion extends from a rear end edge of the blade, positioned on a side where one end of the base portion of the blade is positioned, and extends in the radial direction of the hub to the vicinity of a front end edge of the blade, positioned on a side where the other end of the base portion of the blade is positioned and extending in the radial direction.

9 Claims, 10 Drawing Sheets

Comparative Example

Comparative Example

Comparative Example

AXIAL FLOW FAN

TECHNICAL FIELD

The present invention relates to an axial flow fan.

BACKGROUND ART

Japanese Utility Model Registration No. 3089140 (U.S. Patent Application Publication No. 2003/0123988) discloses in FIGS. 1 to 3 an impeller of an axial flow fan in which a projecting edge 322 curved to form an included angle θ on the upper surface of a blade 32 is formed at a radially outer end portion thereof.

Japanese Utility Model Registration No. 3089140 (U.S. Patent Application Publication No. 2003/0123988) describes that vortices 23 are generated at the radially end portion 13 of the blade as shown in FIG. 5 of the publication if the projecting edge 322 is not formed. Further, the publication describes that the vortex 23 leads to a reduction of static pressure, reduction of air volume, and increase of noise. Furthermore, the publication describes that the formation of the projecting edge 322 allows the static pressure to be increased, air volume to be increased, and noise to be reduced, as compared to when the projection edge 322 is not formed. The inventor of the present invention has confirmed that the effects described in the publication may be obtained. However, from the practical point of view, the amount of dropping at the inflection point appearing in static pressure-air volume characteristics cannot be reduced with a conventional configuration.

SUMMARY OF INVENTION

An object of the present invention is to provide an axial flow fan in which an amount of dropping at the inflection point appearing in air volume-static pressure characteristics may be reduced and noise may also be reduced as compared to conventional axial flow fans.

An axial flow fan according to the present invention includes an impeller, a housing, and a motor. The impeller includes a hub having an annular peripheral wall portion, and a plurality of blades. Each blade has a base portion which is integrally fixed to an outer wall of the peripheral wall portion of the hub. The blades extend outwardly in a radial direction of the peripheral wall portion from the outer wall of the peripheral wall portion, and are disposed at an interval in a circumferential direction of the peripheral wall portion. The housing has a cylindrical air channel in which the impeller rotates. The motor is fixed to the housing and includes a rotary shaft having a front end portion and a rear end portion. The impeller is fixed to the front end portion of the rotary shaft.

The blade used in the present invention has the following features. In order to identify the shape of the blade, an imaginary line is assumed. The imaginary line passes one end of the base portion of the blade positioned on the rear end side of the rotary shaft and extends in parallel to an axial line of the rotary shaft along an outer peripheral surface of the peripheral wall portion. The base portion of the blade is inclined in a direction from the one end of the base portion to the other end thereof so as to be gradually away from the imaginary line in a rotation direction of the impeller and curved so as to be convex in a direction opposite to the rotation direction. The blade has a curved portion formed in the vicinity of a radially outer end portion positioned opposite to the base portion in the radial direction of the hub. The curved portion is convex in the rotation direction, or is concave in the direction opposite to the rotation direction. The curved portion extends along the radially outer end portion from a rear end edge of the blade to the vicinity of a front end edge of the blade. The rear end edge is positioned on a side where the one end of the base portion of the blade is positioned and extends in the radial direction. The front end edge of the blade is positioned on a side where the other end of the base portion of the blade is positioned and extends in the radial direction. The width of the curved portion in the radial direction and depth of a concave portion formed in the curved portion are determined so as to gradually decrease from the rear end edge of the blade to the front end edge thereof.

With the above configuration, it is possible to reduce the amount of dropping at the inflection point appearing in air volume-static pressure characteristics and reduce noise as compared to a conventional axial flow fan in which a projecting edge is formed over the entire length of the radially outer end portion of the blade. The effects obtained in the present invention were confirmed by experiments.

It is preferable that the shape of the blade be determined such that outer surface portions positioned on both sides of the curved portion in the radial direction exist in the same curved surface. In other words, it is preferable that one outer surface portion positioned on one side of the curved portion exist on an extended surface of the other outer surface portion positioned on the other side of the curved portion. By defining the shape of the curved portion in this manner, it is possible to increase the inflection point appearing in air volume-static pressure characteristics and reduce noise as compared to the conventional axial flow fan in which a projecting edge is formed.

It is preferable that, as the impeller is viewed from the front end portion of the rotary shaft toward the rear end portion thereof, an outline of the rear end edge of the blade be curved to be convex in the rotation direction at a position corresponding to the curved portion. By defining the shape in this manner, it is possible to reduce the amount of dropping at the inflection point appearing in air volume-static pressure characteristics and reduce noise.

Assuming that the outer diameter of the impeller is R, it is preferable that the deepest point of the concave portion be positioned within a range from 0.8R to 0.95R. When the deepest point of the concave portion exists at a position closer to the base portion relative to the radial position corresponding to 0.8R, the inflection point of the air volume-static pressure characteristics decreases.

Assuming that the number of blades is N, it is preferable that the length L of the curved portion as measured in the circumferential direction of the peripheral wall portion of the hub be in a range from $2\pi R/(2.8N)$ to $2\pi R/(1.5N)$. If the length L of the curved portion as measured in the circumferential direction is less than $2\pi R/(2.8N)$, the air volume is reduced to cause an increase in the amount of dropping at the inflection point of the air volume-static pressure characteristics. If the length L of the curved portion as measured in the circumferential direction is more than $2\pi R/(1.5N)$, the inflection point of the air volume-static pressure characteristics decreases as a whole, leading to an increase of noise.

It is preferable that the maximum value for the width of the curved portion be in a range from 0.15R to 0.20R. If the maximum value for the width of the curved portion is less than 0.15R, the air volume is reduced to cause an increase in the amount of dropping at the inflection point of the air volume-static pressure characteristics, leading to an increase of noise. If the maximum value for the width of the curved portion is more than 0.20R, the inflection paint of the air volume-static pressure characteristics decreases, leading to an increase of noise.

Further, it is preferable that the maximum value for the depth D of the concave portion of the curved portion be in a range from 0.02R to 0.05R. If the maximum value for the depth D of the concave portion of the curved portion is less than 0.02R, the amount of dropping at the inflection point of the air volume static pressure characteristics is increased to increase noise. If the maximum value for the depth D of the concave portion of the curved portion is more than 0.05R, the inflection point of the air volume-static pressure characteristics significantly decreases to increase noise. Specifically, the maximum value for the depth D of the curved portion may preferably be 1 to 2 mm.

According to the present invention, it is possible to reduce the amount of dropping at the inflection point appearing in air volume-static pressure characteristics than in a conventional axial flow fan in which a projecting edge is formed over the entire length of the radially outer end portion of the blade, which further leads to a reduction in noise.

DESCRIPTION OF EMBODIMENT

Figure 1A:
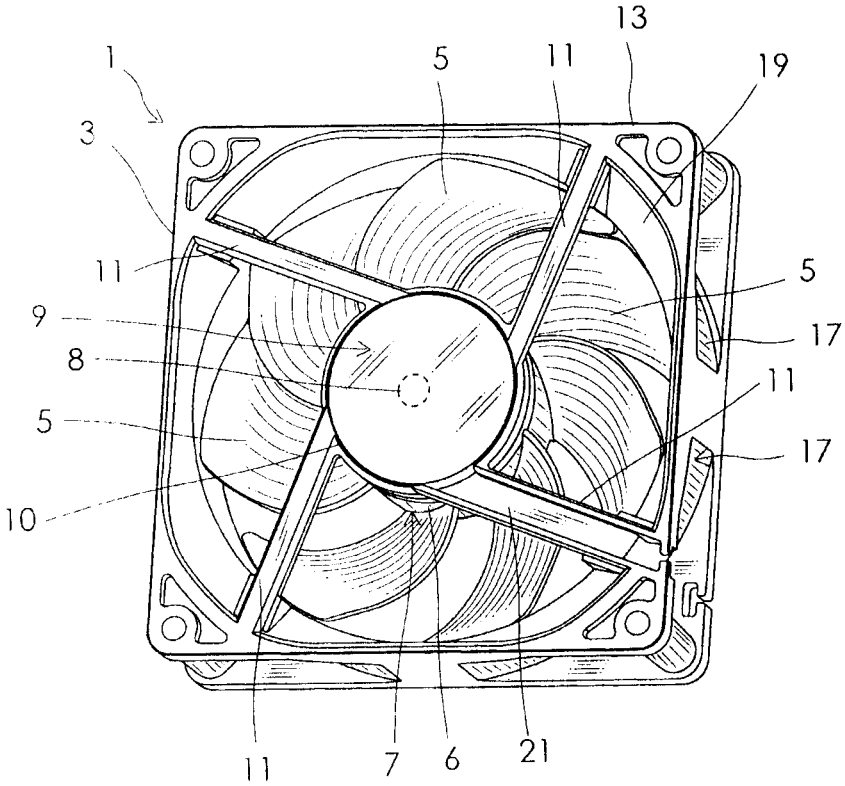
FIGS. 1A and 1B are respectively a front-side perspective view and a rear-side perspective view of an axial flow fan according to an embodiment of the present invention.
Figure 1B:
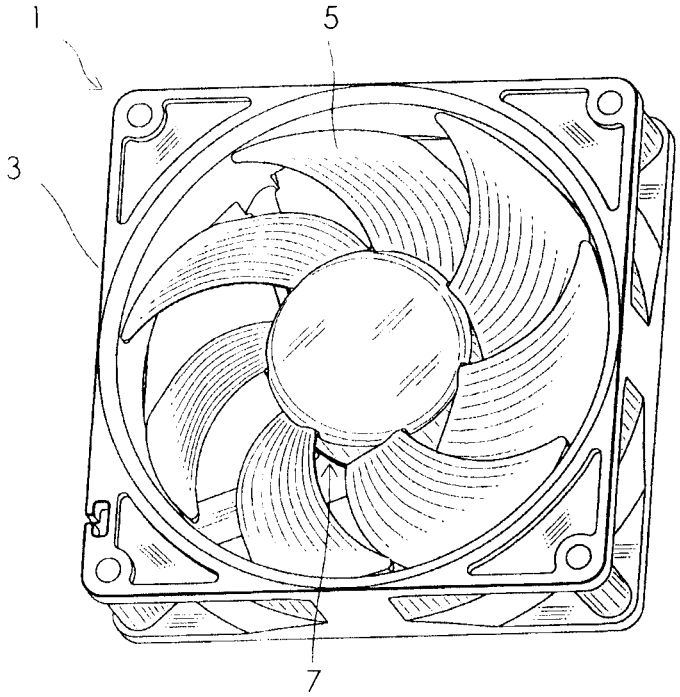

An embodiment of an axial flow fan according to the present invention will be described in detail hereinbelow with reference to the accompanying drawings. FIGS. 1A and 1B are respectively a front-side perspective view and a rear-side perspective view of an axial flow fan 1 according to an embodiment of the present invention. The axial flow fan 1 includes a housing 3, an impeller 7 having seven blades 5 which are disposed in the housing 3 and rotating therein, and a motor 9 which drives and rotates the impeller 7. The motor 9 includes a rotary shaft 8, as indicated with a dot line, having a front end portion and a rear end portion. The impeller 7 is fixed to the front end portion of the rotary shaft 8. A motor case 10 is fixed to the housing 3 through webs 11. The housing 3 has a suction-side flange 13 of an annular shape at one side in an extending direction of the axial line (axial direction) of the rotary shaft 8 and a discharge-side flange 15 of an annular shape at the other side in the extending direction of the axial line. The housing 3 also includes a cylindrical portion 17 between the flanges 13 and 15. An air channel 19 is formed by internal spaces of the suction-side flange 13, the discharge-side flange 15, and the cylindrical portion 17. The impeller 7 is rotated in the air channel 19. The impeller 7 includes a hub 6 having an annular peripheral wall portion 6A and seven blades 5. A plurality of permanent magnets constituting a part of a rotor of the motor 9 are fixed to the inside of the peripheral wall portion 6A of the hub 6.

Figure 2:
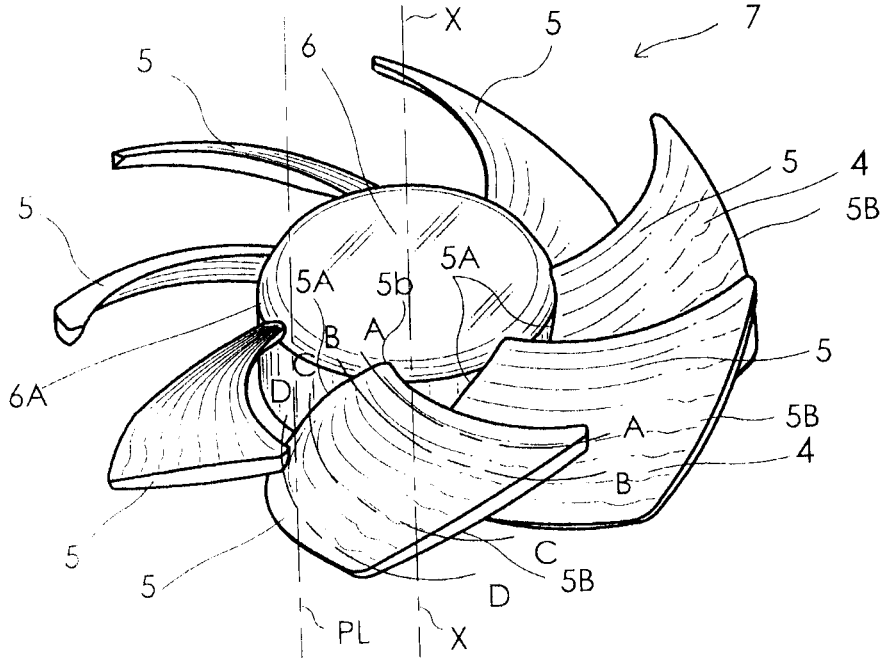
FIG. 2 is an enlarged perspective view of an impeller used in the present embodiment.
Figure 3A:
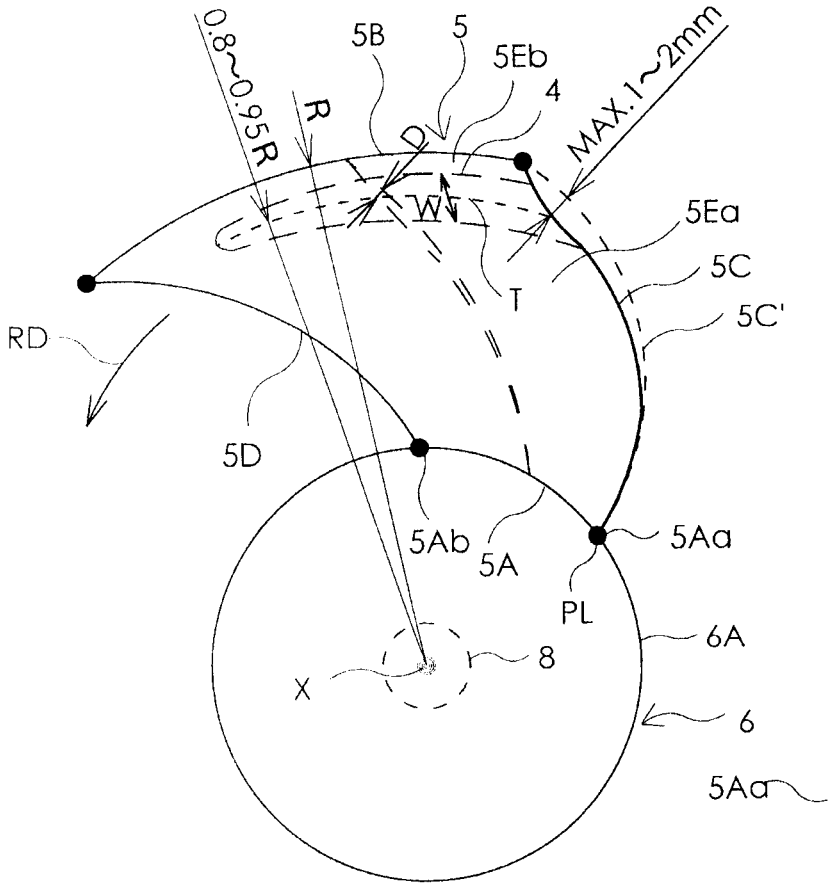
FIG. 3A is a plan view showing that one blade is mounted onto a hub.
Figure 3B:
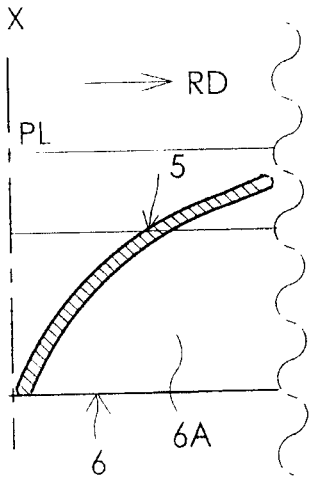
FIG. 3B illustrates that a base portion of one blade is mounted onto the peripheral wall portion of the hub.

FIG. 2 is an enlarged perspective view of the impeller 7 used in the present embodiment. FIG. 3A is a plan view showing that one blade 5 is mounted onto the hub 6, and FIG. 3B is a schematic view explaining that a base portion 5A of one blade 5 is mounted onto the peripheral wall portion 6A of the hub 6. FIGS. 4A to 4D are cross-sectional views respectively taken along lines A-A, B-B, C-C, and D-D of FIG. 2. The seven blades 5 are integrally fixed to an outer wall of the peripheral wall portion 6A of the hub 6 at their base portions 5A. The seven blades 5 extend outwardly in a radial direction of the peripheral wall portion 6A from the outer wall of the peripheral wall portion 6A of the hub 6 and are disposed at an interval in a circumferential direction of the peripheral wall portion 6A.

Figure 4A:
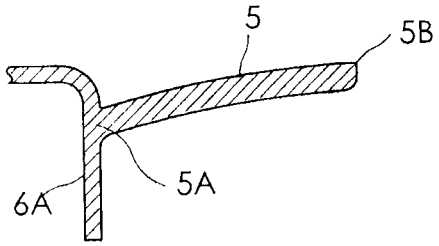
FIGS. 4A to 4D are cross-sectional views respectively taken along lines A-A, B-B, C-C, and D-D of FIG. 2.

Each blade 5 has the following features. In order to identify the shape of the blade 5, an imaginary line PL is assumed to pass one end 5Aa of the base portion 5A of the blade 5 positioned on the rear end side of the rotary shaft 8 and extending in parallel to the axial line X of the rotary shaft 8 along the outer peripheral surface of the peripheral wall portion 6A. As shown in FIG. 3B, the base portion 5A of the blade 5 is inclined in a direction from one end 5Aa of the base portion 5A to the other end 5Ab of the base portion 5A so as to be gradually away from the imaginary line PL in the rotation direction RD of the impeller 7, and curved so as to be convex in a direction opposite to the rotation direction RD. In other words, the blades 5 are fixed to the hub 6 in such a manner that the blades 5 are inclined along the peripheral wall portion 6A of the hub 6 such that the one end 5Aa of the base portion 5A is positioned in the vicinity of an opening portion of the peripheral wall portion 6A of the hub 6 as shown in FIG. 4D and the other end 5Ab of the base portion 5A is positioned more forward in the rotation direction RD than the one end 5Aa and is positioned opposite to the opening portion of the peripheral wall portion 6A as shown in FIG. 3 and FIG. 4A.

Figure 4B:
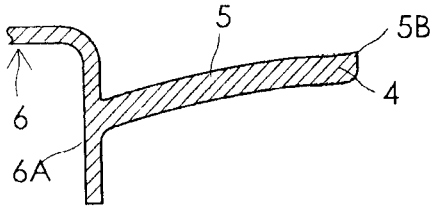
Figure 4C:
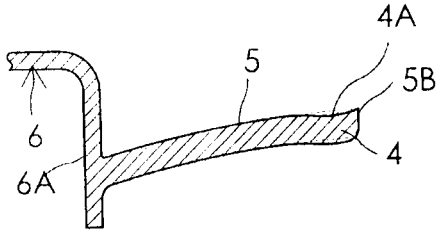
Figure 4D:
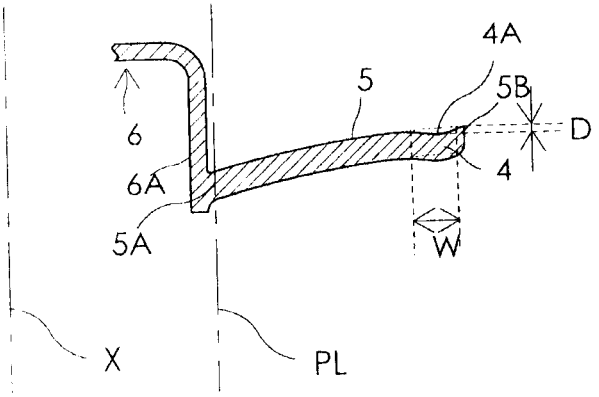

Each blade 5 used in the present embodiment has a curved portion 4 as shown in FIGS. 4B to 4D. The curved portion 4 is formed in the vicinity of a radially outer end portion 5B positioned opposite to the base portion 5A in the radial direction of the peripheral wall portion 6A of the hub 6. The curved portion 4 is convex in the rotation direction RD, and is concave in the direction opposite to the rotation direction RD, and extends along the radially outer end portion 5B of the blade 5. More specifically, as shown in FIG. 3, the curved portion 4 extends along the radially outer end portion 5B from a rear end edge 5C of the blade 5 positioned on a side where the one end 5Aa of the base portion 5A of the blade 5 is positioned and extending in the radial direction of the hub 6 to the vicinity of a front end edge 5D of the blade 5 positioned on a side where the other end 5Ab of the base portion 5A of the blade 5 is positioned and extending in the radial direction of the hub 6.

Further, the shape of the blade 5 is defined such that outer surface portions 5Ea and 5Eb positioned on both sides of the curved portion 4 in the radial direction exist in the same curved surface, in other words, the outer surface portion 5Eb exists on an extended surface of the outer surface portion 5Ea as viewed from the rear end edge 5C side. By defining the shape in this manner, it is possible to reduce the amount of dropping at the inflection point appearing in air volume-static pressure characteristics and reduce noise as compared to a conventional axial flow fan in which a projecting edge is formed.

When the impeller 7 is viewed from the front end portion of the rotary shaft 8 to the rear end portion thereof (i.e., as shown in FIG. 3A), an outline of the rear end edge 5C of the blade 5 is curved to be convex in the rotation direction RD at a position corresponding to the curved portion 4. A dotted line 5C' in FIG. 3A denotes the outline of the rear end edge 5C when the curved portion 4 is not formed. In FIG. 3A, the outline of the rear end edge 5C of the blade 5 is curved in an elongated S-shape.

As shown in FIGS. 3 and 4D, the width W of the curved portion 4 and the depth D of a concave portion 4A formed in the curved portion 4 as measured in the radial direction are determined so as to gradually decrease from the rear end edge 5C toward the front end edge 5D.

As shown in FIG. 3A, assuming that the outer diameter of the impeller 7 is R, it is preferable that the curved portion 4 be formed such that the deepest point of the concave portion 4A is positioned within a range from 0.8R to 0.95R. In FIG. 3A, the locus of the deepest point of the concave portion 4A is denoted by a dotted line T. When the deepest point of the concave portion 4A exists at a position closer to the base portion 5A relative to the radial position corresponding to 0.8R, the inflection point of the air volume-static pressure characteristics significantly decreases as a whole to increase noise.

It is preferable that the maximum value for the width W of the curved portion 4 be in a range from 0.15R to 0.20R. If the maximum value for the width W of the curved portion 4 is less than 0.15R, the air volume is reduced to cause an increase in the amount of dropping at the inflection point of the air volume-static pressure characteristics as a whole, leading to an increase of noise. If the maximum value for the width W of the curved portion 4 is more than 0.20R, the inflection point of the air volume-static pressure characteristics decreases as a whole, leading to an increase of noise. Further, it is preferable that the maximum value for the depth D of the concave portion 4A of the curved portion 4 be in a range from 0.02R to 0.05R. If the maximum value for the depth D of the concave portion 4A of the curved portion 4 is less than 0.02R, the air volume is reduced to cause an increase in the amount of dropping at the inflection point of the air volume-static pressure characteristics, leading to an increase of noise. If the maximum value for the depth D of the concave portion 4A of the curved portion 4 is more than 0.05R, the inflection point of the air volume-static pressure characteristics decreases as a whole, leading to an increase of noise.

Assuming that the number of blades is N, it is preferable that the length L of the curved portion 4 as measured in the circumferential direction of the peripheral wall portion 6A of the hub 6 be in a range from $2\pi R/(2.8N)$ to $2\pi R/(1.5N)$. If the length L of the curved portion 4 as measured in the circumferential direction is less than $2\pi R/(2.8N)$, the air volume is reduced to cause an increase in the amount of dropping at the inflection point of the air volume-static pressure characteristics, leading to an increase of noise. If the length L of the curved portion 4 as measured in the circumferential direction is more than $2\pi R/(1.5N)$, the inflection point of the air volume-static pressure characteristics decreases, leading to an increase of noise.

According to the present embodiment, it is possible to increase the static pressure and air volume in a practicable operating range as compared to a conventional axial flow fan in which a projection edge is formed in the entire radially outer end portion of the blade, thereby reducing noise.

Figure 5:
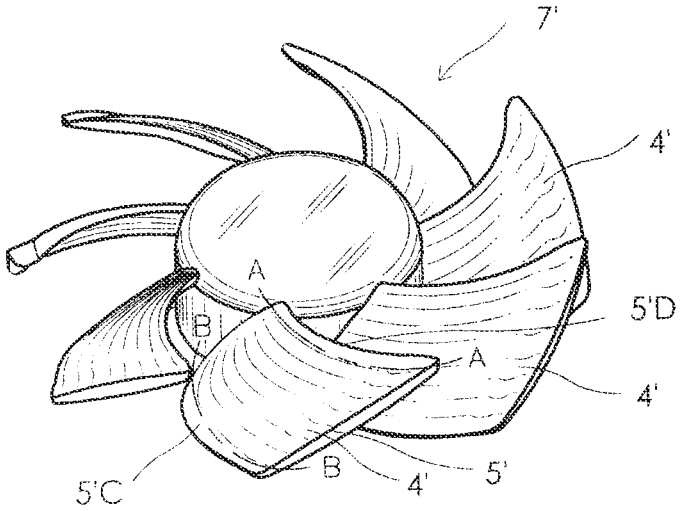
FIG. 5 is a perspective view of an impeller used in an axial flow fan according to a first comparative example.
Figure 6A:
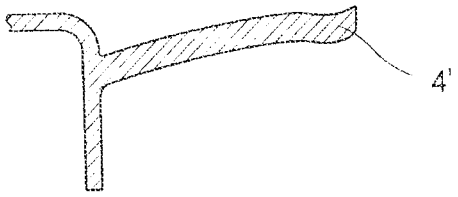
FIGS. 6A and 6B are cross-sectional views respectively taken along lines A-A and B-B of FIG. 5.
Figure 6B:
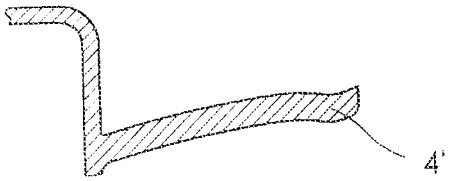
Figure 7:
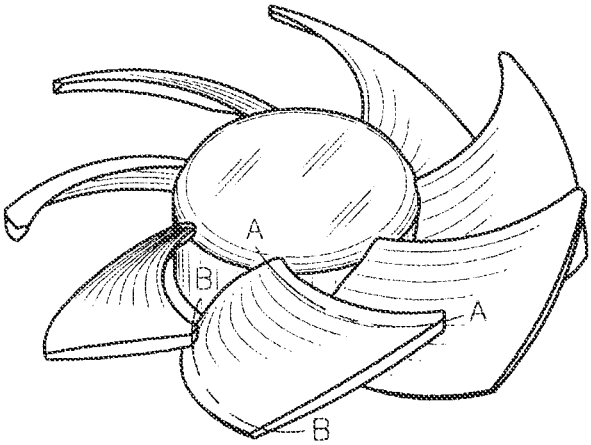
FIG. 7 Prior Art
FIG. 7 is a perspective view of an impeller used in an axial flow fan according to a second comparative example.
Figure 8A:
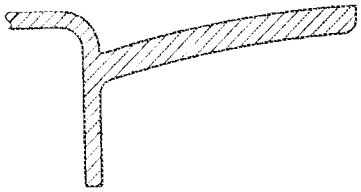
FIG. 8A Prior Art
FIGS. 8A and 8B are cross-sectional views respectively taken along lines A-A and B-B of FIG. 7.
Figure 8B:
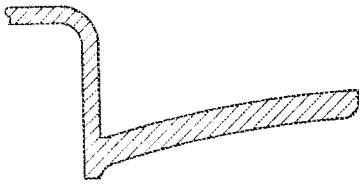
FIG. 8B Prior Art

Next, results of a test for confirming meritorious effects of the axial flow fan according to the present embodiment will be described. FIG. 5 is a perspective view of an impeller used in an axial flow fan according to a first comparative example, and FIGS. 6A and 6B are cross-sectional views respectively taken along lines A-A and B-B of FIG. 5. Unlike the impeller according to the present embodiment, the impeller of the axial flow fan according to the first comparative example has a configuration in which a curved portion 4' is formed over the entire length of a blade 5', from a rear end edge 5'C of the blade 5' to front end edge 5'D thereof. FIG. 7 is a perspective view of an impeller used in an axial flow fan according to a second comparative example, and FIGS. 8A and 8B are cross-sectional views respectively taken along lines A-A and B-B of FIG. 7. Unlike the impeller according to the present embodiment, the impeller of the axial flow fan according to the comparative example 2 does not have the curved portion.

Figure 9:
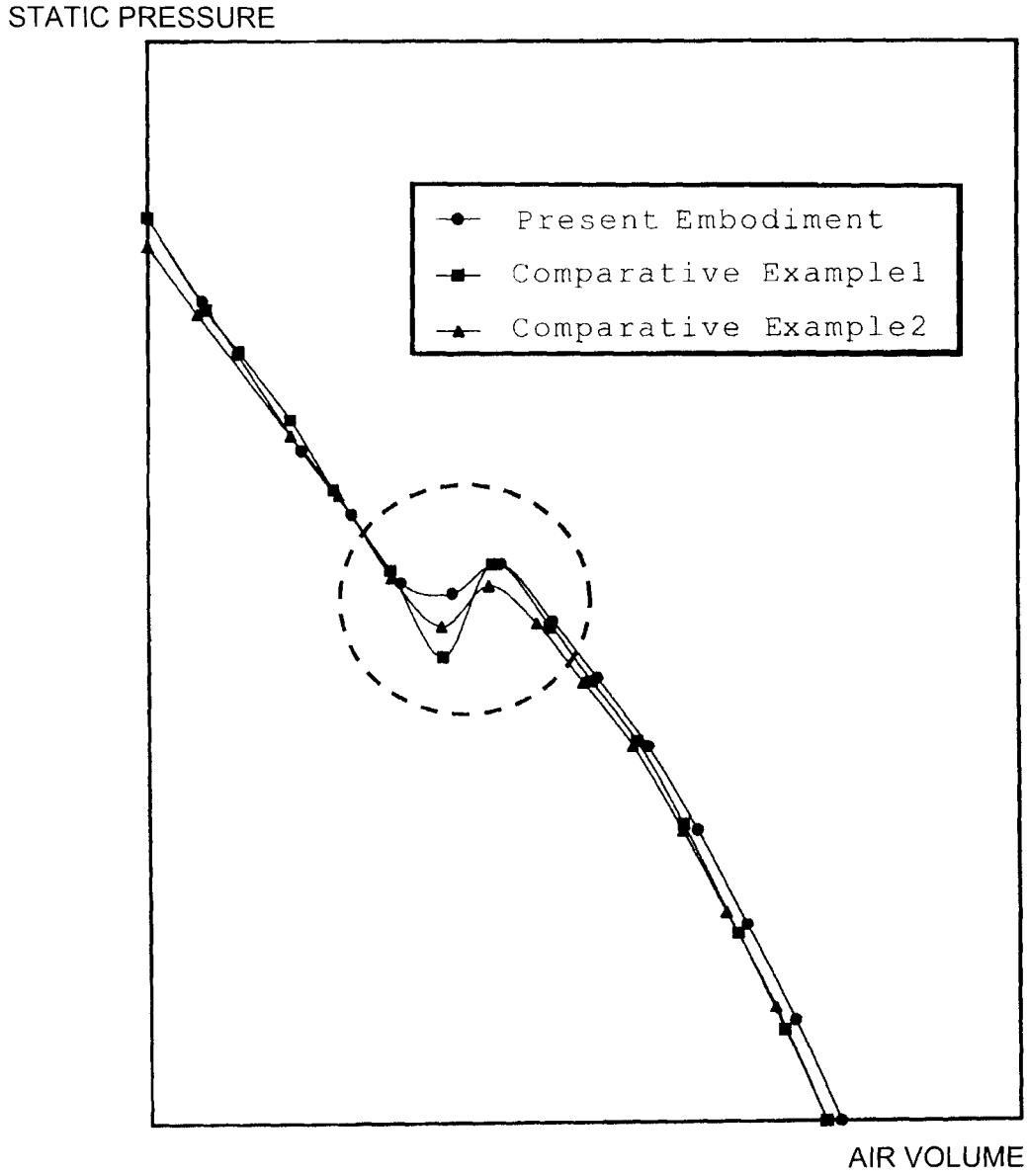
FIG. 9 is a graph showing the air volume-static pressure characteristics of the axial flow fans according to the present embodiment and the first and second comparative examples.

The radius R of the impellers of the axial flow fans used in the test was 43 mm, and rotation speed thereof was 4,400 [$min^{-1}$]. In the axial flow fan according to the present embodiment, the deepest point of the concave portion 4A of the curved portion 4 was set at a position of 0.9R assuming that the outer diameter of the impeller 7 is R. Further, the length L of the curved portion 4 was set to $2\pi R/(1.5N)$, the width W of the curved portion 4 was set to 0.19R, and the maximum value for the depth D of the concave portion 4A was set to 0.03R. FIG. 9 shows the air volume-static pressure characteristics of the axial flow fans according to the present embodiment and the first and second comparative examples under the above conditions. A region surrounded by a dotted line in FIG. 9 is the operating range in which the inflection point appears. In this operating range, the inflection point (point at which the polarity of a variation of characteristics changes) appears. The larger the amount of dropping (decrease in the characteristics) at the inflection point is, the worse the cooling performance of the fan becomes. As can be seen form FIG. 9, the amount of dropping (decrease in the characteristics) at the inflection point in the axial flow fan according to the present embodiment is smaller than that in any of the axial flow fans according to the first and second comparative examples.

Figure 10:
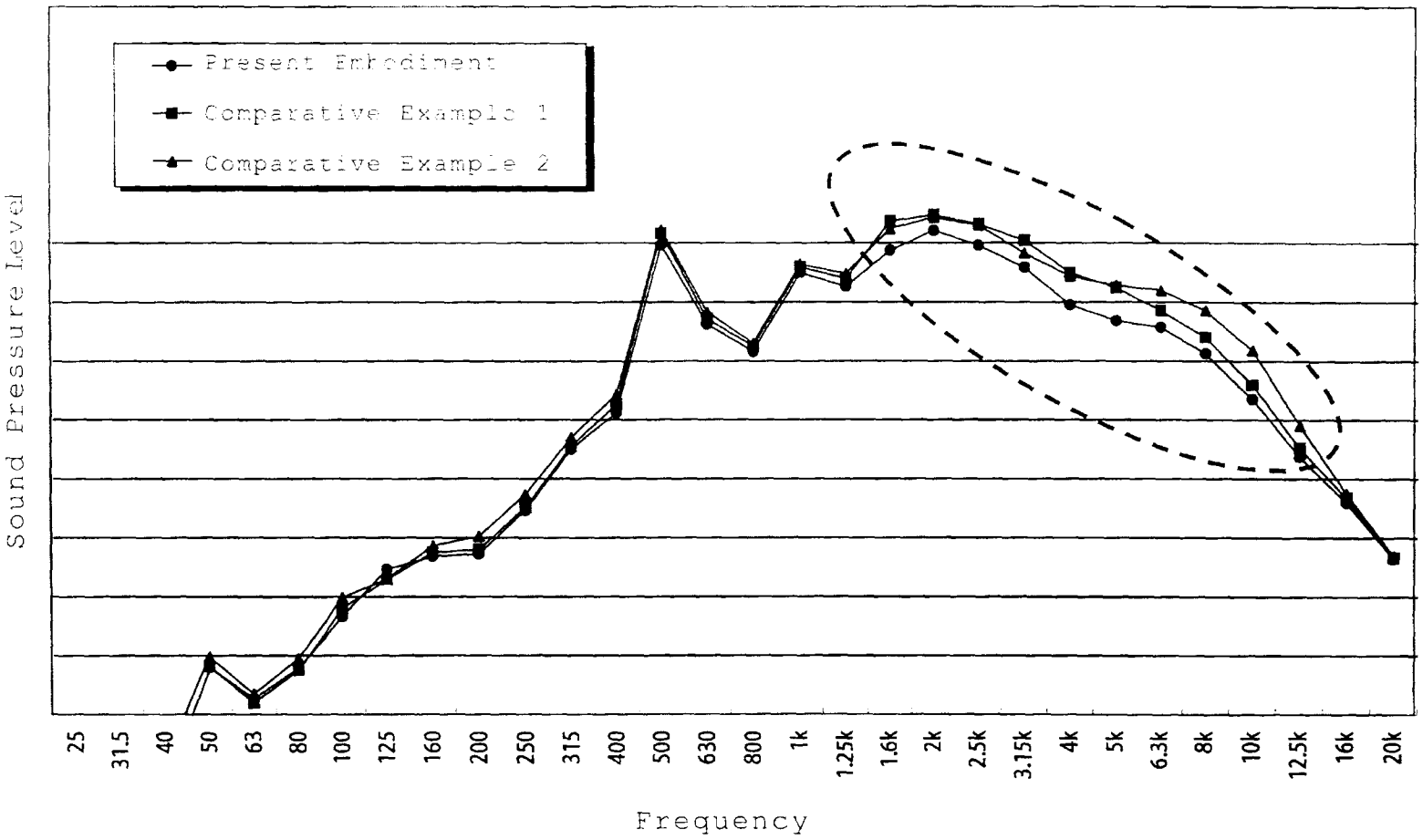
FIG. 10 is a graph showing a relationship between the sound pressure level and frequency component in the axial flow fans according to the present embodiment and the first and second comparative examples.

FIG. 10 shows a relationship between the sound pressure level and frequency component in the axial flow fans according to the present embodiment and the first and second comparative examples measured under the same environment. The noise in the fan is mainly constituted by so-called turbulence noise. This noise is caused by a comparatively high frequency component (range surrounded by a dotted line in FIG. 10: 1.2 kHz to 16 kHz). As can be seen from FIG. 10, the sound pressure level of a frequency component which is a generation source of the noise is reduced in the axial flow fan according to the present embodiment as compared to that in any of the axial flow fans according to the first and second comparative examples.

As can be seen from the results shown in FIGS. 9 and 10, when the curved portion having a predetermined shape is partially formed in the vicinity of the radially outer end portion of the blade as with the axial flow fan according to the present embodiment, it is possible to increase the air volume more than when the curved portion is formed over the entire length of the blade along the radially outer end portion of the blade to increase the inflection point of the air volume-static pressure characteristics, thereby improving the characteristics. In addition, noise may be reduced. Table 1 shown below compares the test results in terms of a relative ratio.

TABLE 1

| | Rotation speed | Maximum air volume | maximum static pressure | Sound pressure level |
|---|---|---|---|---|
| Present embodiment | N | 1.02Q | P | S − 1 |
| Second comparative example | N | Q | P | S |
| First comparative example | N | Q | 0.97P | S + 1 |

Figure 11:
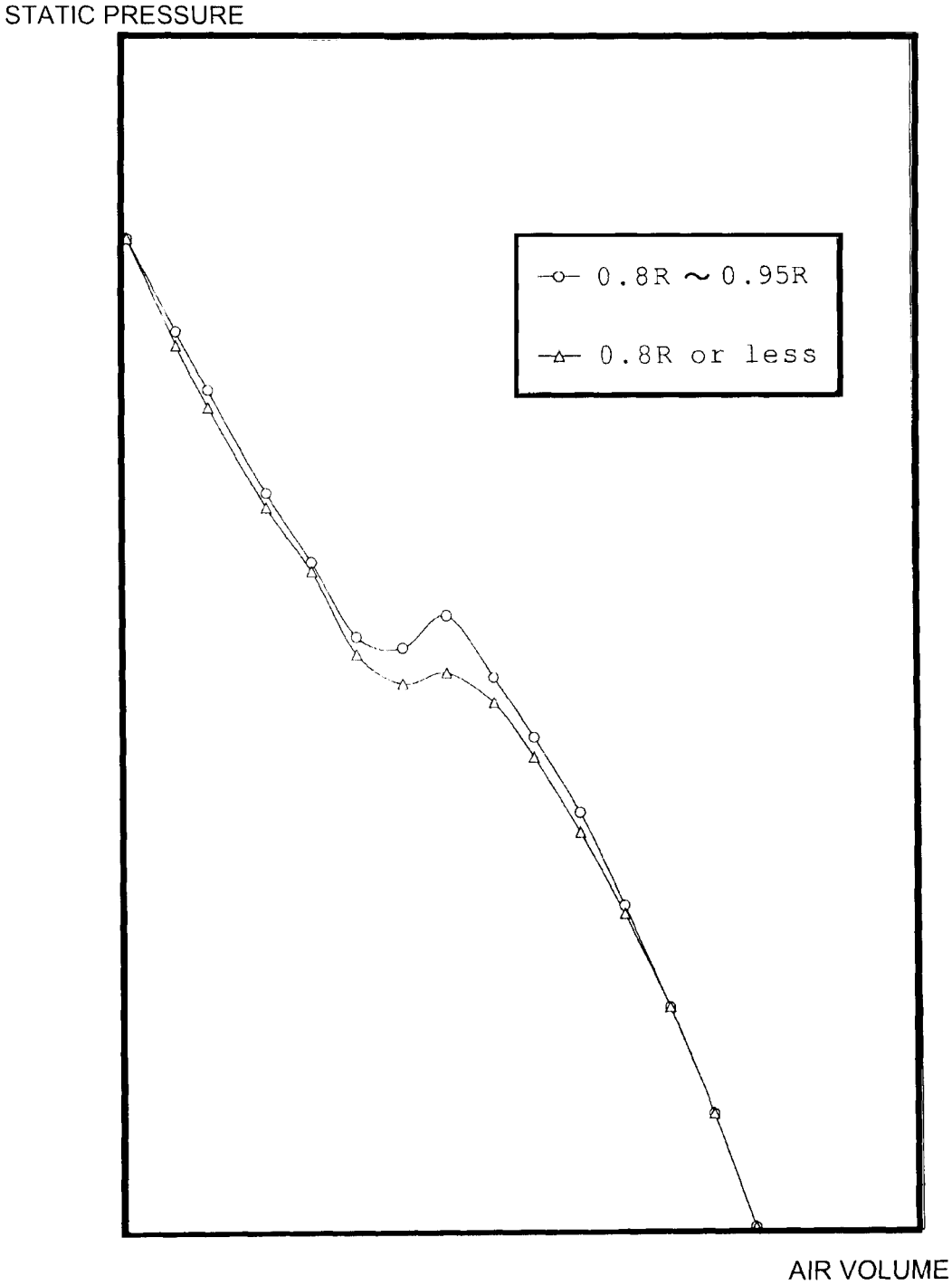
FIG. 11 is a graph showing air volume-static pressure characteristics confirming a proper position range of the curved portion.

FIG. 11 shows average air volume-static pressure characteristics when the deepest point of the concave portion 4A of the curved portion 4 exists in a proper range from 0.8R to 0.95R and the deepest point of the concave portion 4A exists at a position corresponding to less than 0.8R, assuming that the outer diameter of the impeller 7 is R. If the deepest point of the concave portion 4A exists at a position corresponding to more than 0.95R, the characteristics change in the same manner as with when the deepest point of the concave portion 4A exists at a position corresponding to less than 0.8R. In FIG. 11, the length L of the curved portion 4 was set to $2\pi R/(1.5N)$, the width W of the curved portion 4 was set to 0.19R, and the maximum value for the depth D of the concave portion 4A was set to 0.03R. As can be seen from FIG. 11, it is preferable to set the position of the curved portion 4 in the proper range in order to prevent the air volume-static pressure characteristics from being deteriorated.

Figure 12:
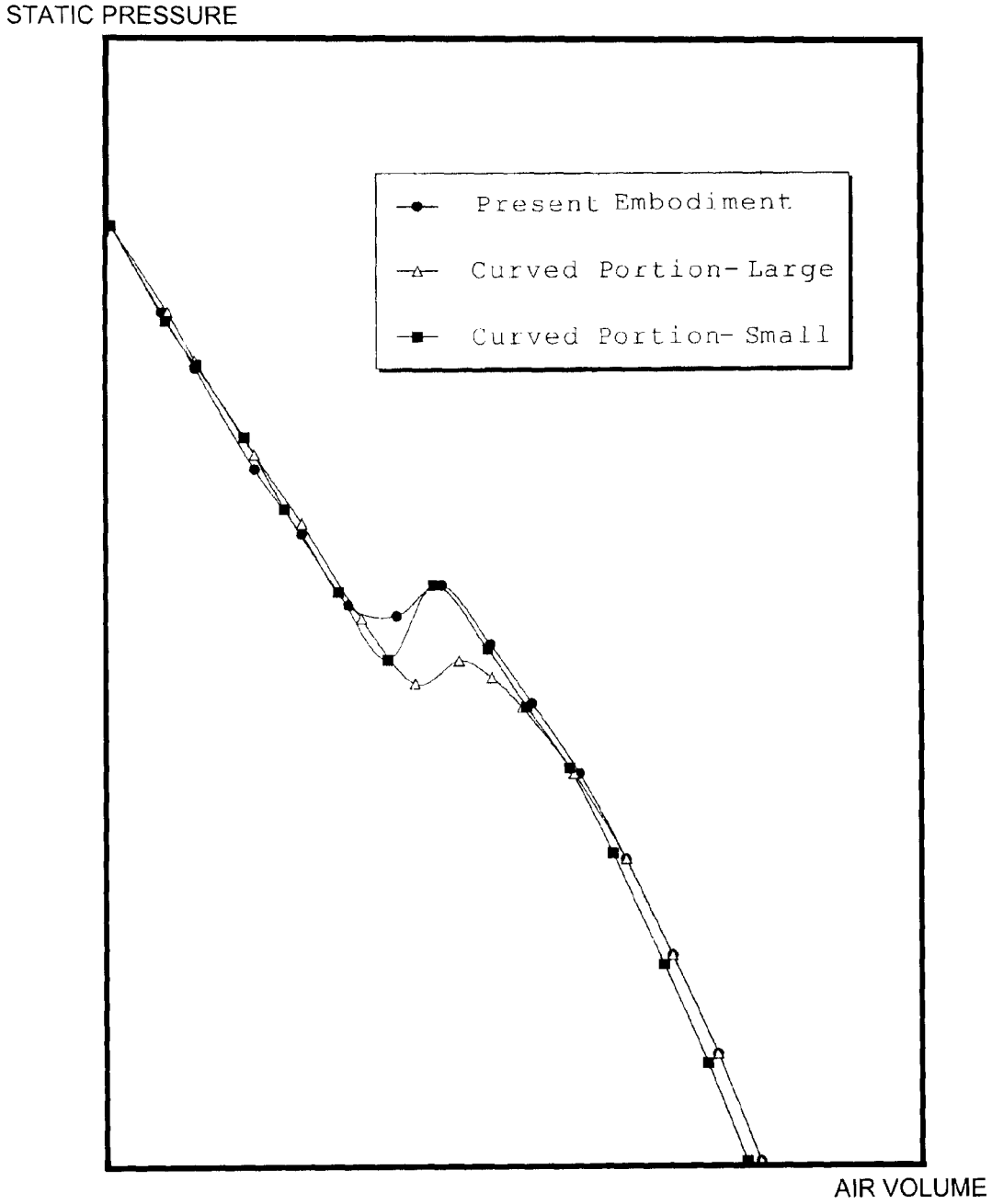
FIG. 12 is a graph showing air volume-static pressure characteristics confirming a proper size range of the curved portion.

FIG. 12 is a graph showing, together with the above-mentioned air volume-static pressure characteristics of the present embodiment, air volume-static pressure characteristics obtained when the position of the curved portion 4 was set to a position corresponding to 0.9R, the length of the curved portion 4 was set to $2\pi R/(1.4N)$, the width W of the curved portion 4 was set to 0.21R, and the maximum value for the depth D of the concave portion 4A was set to 0.051R was defined as "curved portion—large" and when the position of the curved portion 4 was set to a position corresponding to 0.9R, the length of the curved portion 4 was set to $2\pi R/(2.9N)$, the width W of the curved portion 4 was set to 0.14R, and the maximum value for the depth D of the concave portion 4A was set to 0.019R was defined as "curved portion—small". As can be seen from the graph of FIG. 12, it is preferable to set the size of the curved portion 4 in the above-mentioned proper range.

It has been confirmed by the tests that even though the number of blades, the outer diameter of the impeller, the rotation speed of the impeller, and the number and shape of the webs are different, the same result is obtained.

While certain features of the invention have been described with reference to example embodiments, the description is not intended to be construed in a limiting sense. Various modifications of the example embodiments, as well as other embodiments of the invention, which are apparent to persons skilled in the art to which the invention pertains are deemed to lie within the spirit and scope of the invention.

What is claimed is:

1. An axial flow fan comprising:

an impeller including a hub having an annular peripheral wall portion, and a plurality of blades each having a base portion which is integrally fixed to an outer wall of the peripheral wall portion of the hub, extending from the outer wall of the peripheral wall portion outwardly in a radial direction of the peripheral wall portion, and disposed at an interval in a circumferential direction of the peripheral wall portion;

a housing having a cylindrical air channel in which the impeller rotates; and a motor fixed to the housing and including a rotary shaft having a front end portion to which the impeller is fixed and a rear end portion, wherein assuming that an imaginary line passing one end of the base portion of the blade positioned on the rear end portion side of the rotary shaft and extending in parallel to an axial line of the rotary shaft and along an outer peripheral surface of the peripheral wall portion, the base portion of the blade is inclined in a direction from the one end of the base portion to the other end thereof so as to be gradually away from the imaginary line in a rotation direction of the impeller, and is curved so as to be convex in a direction opposite to the rotation direction;

each blade has a curved portion formed in the vicinity of a radially outer end portion positioned opposite to the base portion in the radial direction, the curved portion being convex in the rotation direction, being concave in the direction opposite to the rotation direction;

the curved portion extends along the radially outer end portion from a rear end edge of the blade to the vicinity of a front end edge of the blade, the rear end edge being positioned on a side where the one end of the base portion is positioned and extending in the radial direction, the front end edge of the blade being positioned on a side where the other end of the base portion is positioned and extending in the radial direction;

the width of the curved portion as measured in the radial direction and the depth of a concave portion formed in the curved portion are determined to gradually decrease in a direction from the rear end edge toward the front end edge of the blade; and wherein each blade has a first and a second outer surface portion that are positioned on opposite sides of the curved portion in the radial direction such that said first outer surface portion is radially outside said curved portion and said second outer surface portion is radially inside said curved portion, and wherein said first and second outer surface portions are on a same curved surface that is convex in the direction opposite to the rotation direction such that said first outer surface portion exists on an extension of said second outer surface portion.

2. The axial flow fan according to claim 1, wherein as the impeller is viewed from the front end portion of the rotary shaft toward the rear end portion thereof, an outline of the rear end edge of the blade is curved to be convex in the rotation direction at a position corresponding to the curved portion.

3. The axial flow fan according to claim 1, wherein assuming that the outer diameter of the impeller is R, the curved portion is formed such that the deepest point of the concave portion is positioned within a range from 0.8R to 0.95R.

4. The axial flow fan according to claim 3, wherein assuming that the number of blades is N, the length L of the curved portion as measured in the circumferential direction is in a range from $2\pi R/(2.8N)$ to $2\pi R/(1.5N)$.

5. The axial flow fan according to claim 3, wherein the maximum value for the width of the curved portion is in a range from 0.15R to 0.20R.

6. The axial flow fan according to claim 3, wherein the maximum value for the depth D of the concave portion of the curved portion is in a range from 0.02R to 0.05R.

7. The axial flow fan according to claim 3, wherein the maximum value for the depth D of the concave portion is 1 mm to 2 mm.

8. The axial flow fan according to claim 4 wherein the maximum value for the width of the curved portion is in a range from 0.15R to 0.20R.

9. The axial flow fan according to claim 4, wherein the maximum value for the depth D of the concave portion of the curved portion is in a range from 0.02R to 0.05R.

* * * * *